US009834287B2

(12) United States Patent
Huang et al.

(10) Patent No.: US 9,834,287 B2
(45) Date of Patent: Dec. 5, 2017

(54) FLOATING PLATFORM AND METHOD OF FLOATING STATE KEEPING AND STABILITY CONTROL DURING LOADING AND UNLOADING PROCESS

(71) Applicant: DALIAN UNIVERSITY OF TECHNOLOGY, Dalian, Liaoning (CN)

(72) Inventors: Yi Huang, Liaoning (CN); Wenhua Wang, Liaoning (CN); Yuxin Yao, Liaoning (CN); Maosheng Ye, Liaoning (CN); Gang Liu, Liaoning (CN); Qi Zhang, Liaoning (CN); Hongxia Li, Liaoning (CN); Jingjie Chen, Liaoning (CN); Leilei Dong, Liaoning (CN)

(73) Assignee: DALIAN UNIVERSITY OF TECHNOLOGY, Dalian, Liaoning (CN)

( * ) Notice: Subject to any disclaimer, the term of this patent is extended or adjusted under 35 U.S.C. 154(b) by 232 days.

(21) Appl. No.: 14/434,552

(22) PCT Filed: Mar. 20, 2014

(86) PCT No.: PCT/CN2014/073738
§ 371 (c)(1),
(2) Date: Apr. 9, 2015

(87) PCT Pub. No.: WO2015/139256
PCT Pub. Date: Sep. 24, 2015

(65) Prior Publication Data

US 2015/0344114 A1 Dec. 3, 2015

(30) Foreign Application Priority Data

Mar. 20, 2014 (CN) ..... 2014 1 0106561

(51) Int. Cl.
*B63B 39/06* (2006.01)
*B63B 39/03* (2006.01)
(Continued)

(52) U.S. Cl.
CPC ..... *B63B 39/03* (2013.01); *B63B 25/08* (2013.01); *B63B 35/4413* (2013.01)

(58) Field of Classification Search
CPC ..... B63B 35/4413; B63B 2001/044; B63B 1/048
See application file for complete search history.

(56) References Cited

U.S. PATENT DOCUMENTS 4,502,551 A * 3/1985 Rule ..... B63B 35/4413 114/264
4,606,673 A * 8/1986 Daniell ..... B63B 22/021 114/256
2011/0107951 A1* 5/2011 Vandenworm ..... B63B 1/041 114/125

FOREIGN PATENT DOCUMENTS

CN 102149598 A 8/2011
CN 103085946 A 5/2013
(Continued)

*Primary Examiner* — Edwin Swinehart
(74) *Attorney, Agent, or Firm* — Novick, Kim & Lee, PLLC; Allen Xue

(57) ABSTRACT

The present invention discloses a floating platform, wherein multiple layers of compartments are configured along the height direction of the floating platform, and the center of gravity of each layer of compartments in a full-load process and a loading and unloading process is always located on a vertical line where the whole center of gravity of the floating platform is located; the multiple annular compartments are of equal-ratio subdivision in volume: the volume ratio of every two adjacent upper and lower annular compartments is inversely proportional to the density of liquid stored in the compartments; in the practical loading process, the floating
(Continued)

platform is always kept at a constant displacement to maintain the waterplane unchanged by adjusting crude oil or seawater loaded in different layers of compartments, and thus the floating plate always has optimal hydrodynamic performance.

11 Claims, 8 Drawing Sheets

(51) Int. Cl.
*B63B 25/08* (2006.01)
*B63B 35/44* (2006.01)

(56) References Cited

FOREIGN PATENT DOCUMENTS

| | | | |
|---|---|---|---|
| CN | 103085947 | A | 5/2013 |
| CN | 103171743 | A | 6/2013 |
| CN | 103832556 | A | 6/2014 |
| FR | 2877640 | A1 | 5/2006 |

* cited by examiner

FLOATING PLATFORM AND METHOD OF FLOATING STATE KEEPING AND STABILITY CONTROL DURING LOADING AND UNLOADING PROCESS

TECHNICAL FIELD

The present invention relates to a floating platform and a method of controlling the floating state and the stable state of the floating platform in the loading and unloading process, relating to a ship having a patent classification of B63 and other waterborne vessels; ship-related equipment B63B and other waterborne vessels; and shipborne equipment B63B35/00 suitable for ships for special purposes or similar floating buildings having a floating structure B63B35/44, waterborne cabins, waterborne drilling platforms or waterborne workshops, for instance, which are loaded with oil-water separation equipment.

BACKGROUND ART

In 2013, the Yougang Tang's team proposed a novel multi-drum FPSO (also can be FDPSO) made of concrete materials in the National Water Conservancy Project Simulation and Safety Key Laboratory in Tianjin University (refer to FIG. 1). Said novel multi-drum FPSO adopts the patented technology 'Airtight Air Pressure Communicating Type Ballast Seawater and Crude Oil Constant-Specific Mass Flow Replacement Process' proposed by the specialist Zhi-Rong Wu in China National Offshore Oil Corporation as a design basis and realizes the optimization on the hydrodynamic performance of the novel floating body [1].

This technology mainly lies in that an oil storage compartment intercommunicates with the top of a ballast seawater compartment through a pipeline, the compartment body is airtight, but prefilled with nitrogen having a certain pressure, and a crude oil inlet pump and a seawater unloading pump as a group are in linkage with a crude efflux pump and a seawater ballast pump as another group, respectively, so as to realize constant-specific mass flow replacement. This technology aims at ensuring unchanged weight of the floating body, unchanged scantling draft and small amplitude of vertical variation of center of gravity in the oil storage and efflux process.

This oil storage technology has the outstanding advantages that the floating body is always kept at the same stable state, and the optimization of the hydrodynamic performance is realized; secondly, due to the separate storage of ballast water and crude oil, the pollution to the marine environment is reduced to a great extent; but simultaneously has the following unignorable defects.

Firstly, the total mass tremendously changes and the hydrodynamic performance has huge difference under full-load and unloaded working conditions, both of which are hard to reconcile in the design process. In today's increasingly intensified and multi-functionalized maritime work development, the importance of effective loading capacity is more and more prominent to become a very important performance and economic indicator for a platform. According to this technology, the platform is required to have to reserve enough fixed ballast in order to make the constant draft reservation space ratio approach to 4:5, which itself is extremely wasteful to the loading capacity of the platform, and thus greatly reduces the economy of the platform.

Secondly, the cost input of equipment, such as a nitrogen generating device, a pressure control device and a storage tank with an inner layer and an outer layer, of this patient is unignorablely high due to the complex process; and further, the use reliability of the equipment is reduced and potential risk of prolonging the downtime exists. The schematic diagram of devices is as shown in FIG. 2.

In 2006, in new concept FPSO/FDPSO cooperatively studied by France DORIS Corporation and Technical University of Lisbon, an innovative water-oil mixing storage technology [2,3] is adopted in order to keep the platform at a constant floating state and control the waterplane area (referring to FIG. 3).

According to the principle that densities of crude oil and water are different, crude oil is located at the upper part of the oil storage compartment, and water is located at the lower part of the oil storage compartment. In the production process, oil entering the oil compartment expels water with the same volume to sea through a water treatment system. The water treatment system ensures the cleanliness of water drained. On the other hand, in the output process of oil, the volume of output oil is filled up by seawater in the sea entering the oil compartment. In order to keep draft constant, ballast water with the same weight must enter or must be removed to compensate the volume change of oil and water, which can be achieved by a ballast water compartment supplied by each column. In the loading and unloading process, any sudden change of the oil-water compartment can be restricted by an atmosphere regulating compartment, and the interface between oil and water can freely fluctuate in the atmosphere regulating compartment. In the loading process, oil is filled into an oil buffer compartment which is connected with four oil storage compartments in a caisson. When the oil level in the buffer compartment rises, water at the lower part of the oil storage compartments can be drained to a water buffer compartment by virtue of increased height of an oil column. Water in the water buffer compartment is pumped into the water treatment device through a submerged pump and is then drained to the sea. The design concept map of the oil storage compartments is as shown in FIG. 4.

The oil storage compartment has the advantages that the total mass of the platform can be effectively controlled not to change to further keep the floating state unchanged, the loading capacity of the platform is sufficiently utilized and favorable economy is achieved, but has serious defects as well.

Firstly, at the stage of coexistence of water and oil, the interface between water and oil can continuously change along the movement of the floating body, it is inevitable to cause the emulsification problem on the inference in the sway process since oceanic conditions change at every moment, and therefore, the input/output speed must be strictly controlled to prevent water and oil from mixing. Since the emulsification phenomenon is serious resulting from complex oceanic conditions, the crude oil input/output work cannot be continued until the interface between oil and water is clear after standing a period of time, which seriously restricts the sufficient exertion of the processing capacity of the platform and reduces the operation efficiency, and even so, the emulsification problem cannot be completely eradicated yet.

Secondly, since water and oil are stored in a mixed manner, ballast water of certain height will be reserved in the compartments for preventing crude oil from entering the water buffer compartment according to the design requirements even under the condition of full load of crude oil. Water and oil are inevitably fused to each other in this longer period from oil production to crude oil unloading, and there will be a large number of salts in seawater to enter crude oil, resulting in increase of salt content of crude oil and reduction of crude oil quality.

Then, the crude oil needs to be stored by heating under normal conditions due to high solidifying point, however, in view of coexistence of water and oil, heat exchange inevitably exists to cause loss of a lot of heat along with drainage of ballast water, which will further cause waste of a lot of heat energy and increase of the operation cost of the platform and simultaneously bring unnecessary troubles for subsequent transfer of crude oil.

Finally, in order to protect the marine environment, the water and oil mixing storage technology brings great pressure to subsequent ballast water treatment. Differing from a washing process flow, the oil content of the ballast water will be greatly increased according to this technology, and it means that treatment equipment with higher capacity is needed to meet the technological flow requirement, so just one factor of restricting the operation efficiency is added.

SUMMARY OF THE INVENTION

The present invention has been devised to solve such technical problems, and an object thereof is to provide a floating platform, wherein multiple layers of compartments are configured along the height direction of the floating platform, the center of gravity of each layer of compartments in a full-load process and a loading and unloading process is always located on a vertical line where the center of gravity of the whole floating platform is located. In the actual loading process, the floating platform is always kept at a constant displacement to maintain the waterplane unchanged by adjusting crude oil or seawater loaded in different layers of compartments so as to ensure that the floating plate always has optimal hydrodynamic performance.

It is preferred that the floating platform has optimal hydrodynamic performance while being fully loaded with crude oil, and at this moment, both the displacement and waterplane are at an optimal state. In the crude oil output process, the center of buoyancy of the floating platform is kept constant by filling part of compartments in multiple layers of compartments with seawater (the density of seawater is greater than that of crude oil). Whereas, the center of gravity of each layer of compartments is always located on the vertical line where the whole center of gravity of the floating platform is located, and thus ensuring that the floating platform is always at an upright state and guaranteeing the stability of the floating platform.

Further, it needs to be considered that a set of crude oil filling and outputting pipelines and seawater filling and outputting pipelines as well as matched valves are at least configured for each compartment; in the meantime, a complex control system is also required to control the filling and discharging speed and time of each compartment so as to keep the centers of gravity of multiple compartments unchanged, so the production cost is high.

Therefore, multiple compartments in each layer are configured into a structure of communicating vessels, just one set of pipelines and valves are set for each layer of compartments, the quantity of the pipelines and valves are greatly reduced, and meanwhile the control system and complex control steps are also omitted.

Further, it needs to be considered that a free surface possibly exists to affect the stability of the floating platform under a terrible ocean environment since the volumes of the multiple compartments forming the communicating vessels are different.

Therefore, each layer of compartments is designed into an annular compartment with equal internal diameter and corresponding input/output valves are configured at the bottom of the annular compartment, which can ensure that the increased weight of each layer of annular compartment is appropriately and uniformly distributed in the annular compartment, that is to say, the center of gravity of each layer of annular compartment is always kept unchanged and thus the stability of the platform is increased.

Further, in order to further reduce the affect of the free surface on the stability of the platform, it is preferred that multiple transverse bulkheads are configured in the annular compartment to partition said annular compartment into multiple independent compartments, wherein an opening is formed in the lower side of each transverse bulkhead, that is to say, the multiple independent compartments form communicating vessels utilizing the theory of communicating vessels. The area of the free surface is further reduced and the stability of a ship is increased.

Further, the volume of each layer of annular compartments has a proportional relation with its adjacent annular compartment, i.e., the volume ratio of the adjacent upper and lower annular compartments is inversely proportional to the density of liquid stored in both of them. When liquids stored in the floating platform are seawater and crude oil, the volume ratio of the annular compartment follows the formula:

$$\frac{V_B}{V_A} = \frac{\rho_{water}}{\rho_{oil}}$$

wherein $V_A$ is the volume of the lower annular compartment of two adjacent annular compartments; and $V_B$ is the volume of the upper annular compartment of compartment A. Due to the adoption of equal-ratio subdivision, equal mass replacement can be always kept in the process of loading and unloading crude oil (filling empty compartments with seawater), the metacentric height change in the loading and unloading process is always kept to tend to a safe and controllable state so as to ensure the stability of the platform.

As a preferred embodiment, in order to cooperate with the multiple annular compartments to load and unload crude oil, load regulating compartments are also configured at the bottom of the floating platform, wherein the volume ratio of the load regulating compartments to the annular compartment positioned above it is inversely proportional to the volume of liquid stored in both of them. Similar to other annular compartments positioned on the upper layer, both the centers of gravity of the loading regulating compartments and the centers of gravity of other annular compartments are positioned on said vertical line;

at a full-load state of crude oil: all annular compartments are filled with crude oil and the load regulating compartments are in an unloaded state;

during crude oil output operation: the following steps are performed, namely pouring seawater into the load regulating compartments, and pumping out crude oil from the annular compartment positioned above the load regulating compartments; filling the annular compartment from which crude oil is evacuated with seawater and pumping out crude oil from the annular compartment positioned above said annular compartment; and repeating said process till the annular compartment positioned on the topmost layer is in an unloaded state, and thus finishing crude oil output; and during crude oil input operation: the following steps are performed, namely pouring crude oil into the annular compartment on the top layer at an unloaded state, and evacuating seawater in the annular compartment on the sub-top layer; and repeating said process till the annular compartment on the bottommost layer is filled with crude oil and the load regulating compartments are in an unloaded state.

As another embodiment, the volume of the annular compartment positioned on the topmost layer in the floating platform is smaller than that of the annular compartment on the sub-top layer.

Correspondingly, the floating platform is equipped with a double-layer hull and a double-layer bottom, wherein load regulating compartments, which are an annular loading regulating compartment I and an annular load regulating compartment II, are configured in the double-layer bottom; and the centers of gravity of the two load regulating compartments are overlapped and positioned on said vertical line;

The mass of seawater filled in the load regulating compartment I or the load regulating compartment II is equal to the mass difference between seawater filled in the annular compartment on the sub-top layer and the crude oil filled in the annular compartment on the top layer;

in a full-load state of crude oil: all annular compartments are filled with crude oil and the load regulating compartment I and the load regulating compartment II are kept at an unloaded state;

during crude oil output operation: the following steps are performed, namely pouring seawater into the load regulating compartment I and the load regulating compartment II, respectively and simultaneously beginning to pump crude oil from the annular compartment positioned above the load regulating compartments; pouring seawater into the annular compartment from which the crude oil is evacuated and simultaneously pumping crude oil in the annular compartment positioned above said annular compartment; repeating said process till the annular compartment on the topmost layer is at an evacuated state; and when the crude oil in the annular compartment on the top layer is evacuated, evacuating the seawater loaded in the load regulating compartment I or the load regulating compartment II in order to keep the center of gravity of the floating platform unchanged; and during crude oil input operation: the following steps are performed, namely pouring crude oil into the annular compartment on the top layer at the unloaded state with, beginning to evacuate seawater in the annular compartment on the sub-top layer and simultaneously filling the load regulating compartment I or the load regulating compartment II with seawater so as to keep the center of gravity of the floating platform unchanged; and repeating said process till the annular compartment on the bottommost is filled with crude oil and the load regulating compartment I and the load regulating compartment II are unloaded at this moment.

A method of keeping a floating state and controlling the stability of the floating platform having the structure descried in the embodiment I in the loading and unloading process comprises the following steps:

in a full-load state of crude oil: filling all annular compartments with crude oil and maintaining the load regulating compartments in an unloaded state;

during crude oil output operation: filling the load regulating compartments with seawater, and pumping crude oil from the annular compartment positioned above the load regulating compartments; filling the annular compartment from which crude oil is evacuated with seawater and pumping crude oil from the annular compartment positioned above said annular compartment; and repeating said process till the annular compartment positioned on the topmost layer is at an unloaded state, and thus finishing crude oil output; and during crude oil input operation: the following steps are performed, namely pouring crude oil into the annular compartment on the top layer in an unloaded state, and evacuating seawater in the annular compartment on the sub-top layer; and repeating said process till the annular compartment on the bottommost layer is filled with crude oil and the load regulating compartments are in an unloaded state.

A method of keeping a floating state and controlling the stability of the floating platform having the structure descried in the embodiment II in the loading and unloading process comprises the following steps:

in a full-load state of crude oil: all annular compartments are filled with crude oil and maintaining the load regulating compartment I and the load regulating compartment II are in an unloaded state; and when the crude oil in the annular compartment on the top layer is evacuated, evacuating seawater loaded in the load regulating compartment I or the load regulating compartment II;

during crude oil output operation: filling the load regulating compartment I and the load regulating compartment II with seawater and pumping crude oil from the annular compartment positioned above the load regulating compartments; filling the annular compartment from which the crude oil is evacuated with seawater and pumping crude oil in the annular compartment positioned above said annular compartment; and repeating said process till the annular compartment on the topmost layer is in an unload state; and during crude oil input operation: filling the annular compartment on the top layer in an unloaded state with crude oil, evacuating seawater in the annular compartment on the sub-top layer and filling the load regulating compartment I or the load regulating compartment II with seawater; and repeating said process till the annular compartment on the bottommost is filled with crude oil and the load regulating compartment I and the load regulating compartment II are unloaded at this moment.

Due to the adoption of the above-mentioned technical solution, compared with the prior art, the floating platform and the method of the floating state keeping and stability control thereof in the loading and unloading process has the following advantages:

1. constant displacement is maintained and the waterplane position is kept unchanged, and thus the platform can always provide the set optimal hydrodynamic performance;

2. oil and water are separately stored to eradicate the emulsification phenomenon of crude oil and water and the problem of blend of salts from seawater to crude oil, and the crude oil quality is guaranteed;

3. oil and water are separately stored to furthest reduce the heat loss of crude oil and reduce the requirement on a heat supply system, and thus the operation cost of the platform is reduced;

4. the ballast water compartment does not need to be independently configured, thus furthest increasing the space utilization ratio of the platform, and the effective load of the platform is sufficiently utilized to improve the loading capacity, and thus the practical economical efficiency of the platform is greatly improved;

5. the platform is always kept an upright state in the loading and unloading process by applying the theory of communicating vessels;

6. it is available to implement by equipment essential to the traditional platform without special design by applying the theory of communicating vessels, and the design is simple; further, it is very convenient to upgrade and reconstruct the original old oil storage platform by adopting said technology;

7. the piping layout can be furthest reduced by applying the theory of communicating vessels, and thus the construction cost is reduced;

8. the compartments are arranged from small to big by adopting the principle of equal-ratio subdivision in volume, so as to ensure that the metacentric height change always tends to the safe and controllable state in the loading and unloading process, and thus excellent stability of the platform is guaranteed; and 9. the load regulating compartments can be configured conveniently to configure load regulating water by applying the principle of equal-ratio subdivision in volume, so that the load distribution operation is simplified, which is conductive to decreasing the free surface in the compartment.

BRIEF DESCRIPTION OF THE DRAWINGS

Accompanying drawings that need to be used in description of the embodiments or the existing technology will be briefly introduced below in order to illustrate the embodiments of the present invention and the technical solution of the existing technology, and it is apparent for those common skilled in the art that the accompany drawings described as below are just some embodiments of the present invention and other accompany drawings can be acquired on the basis of those accompany drawings on the premise of not paying creative work.

DETAILED DESCRIPTION OF THE PREFERRED EMBODIMENTS

Figure 1:
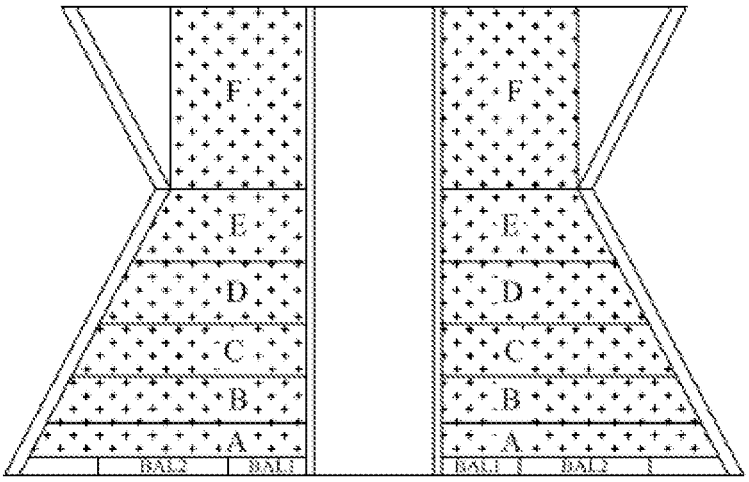
FIGS. 1 to 14 are schematic diagrams of the embodiment of the present invention in the loading and unloading process.
Figure 2:
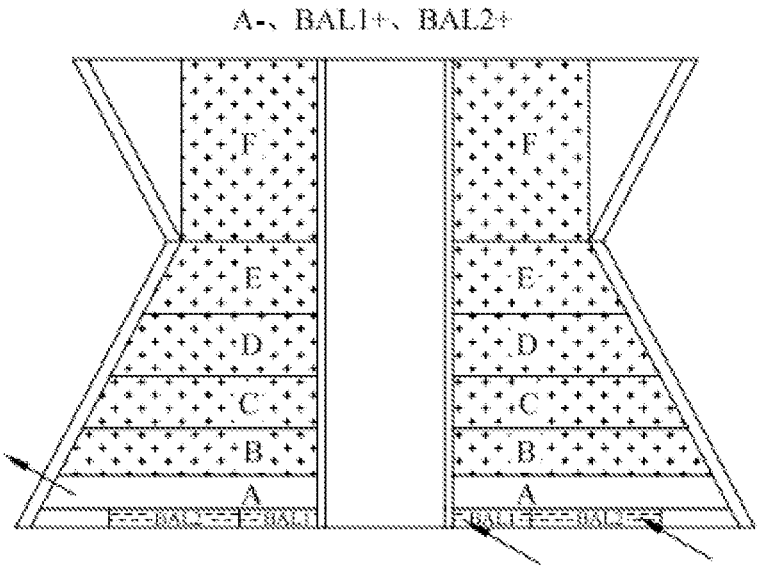
Figure 3:
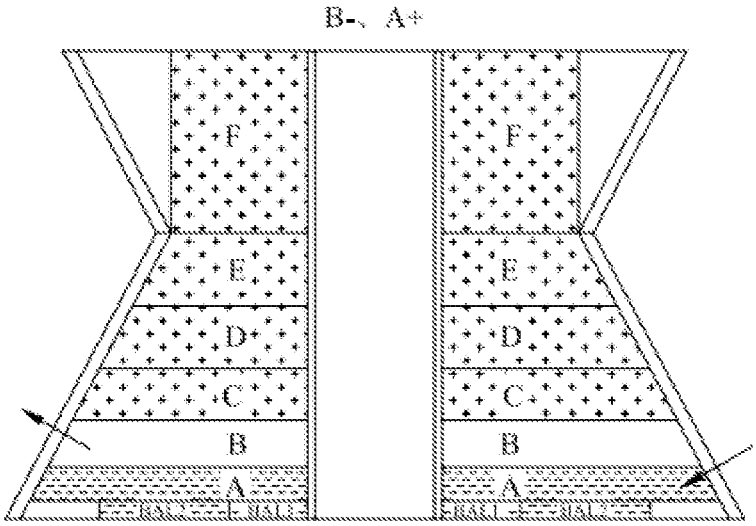
Figure 4:
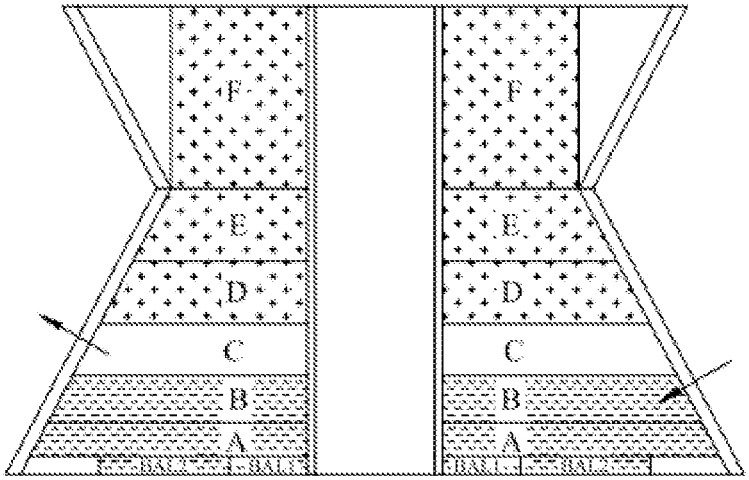
Figure 5:
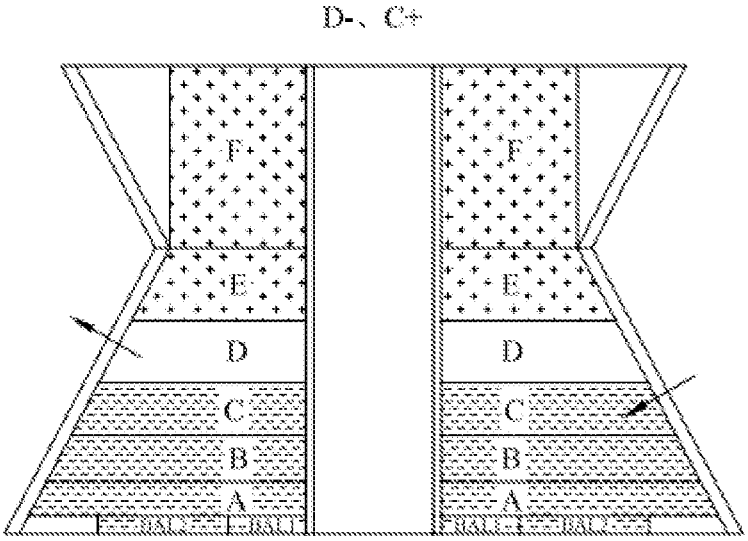
Figure 6:
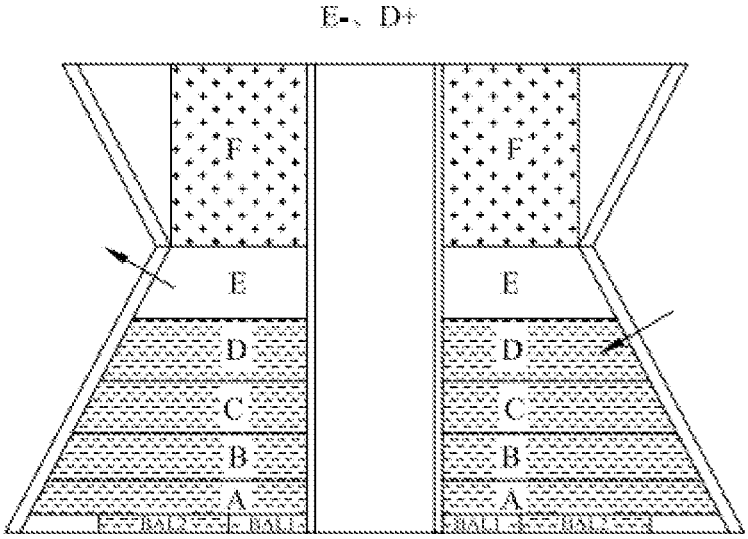
Figure 7:
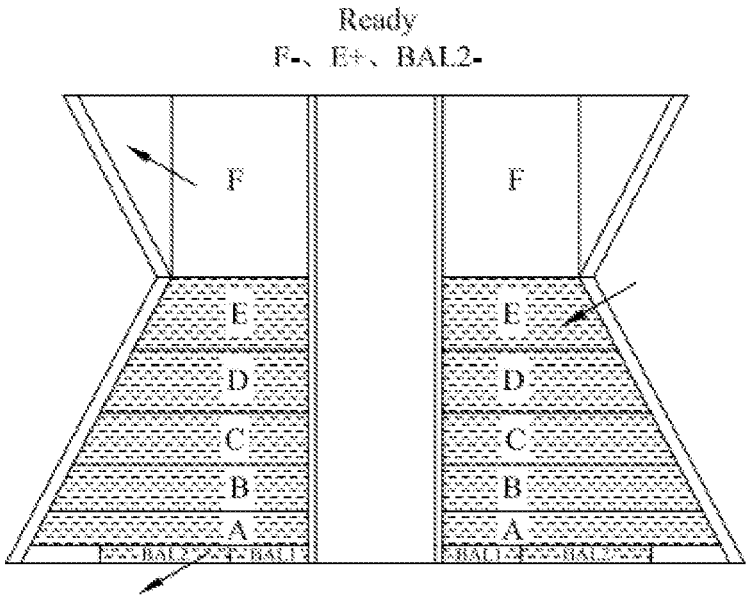
Figure 8:
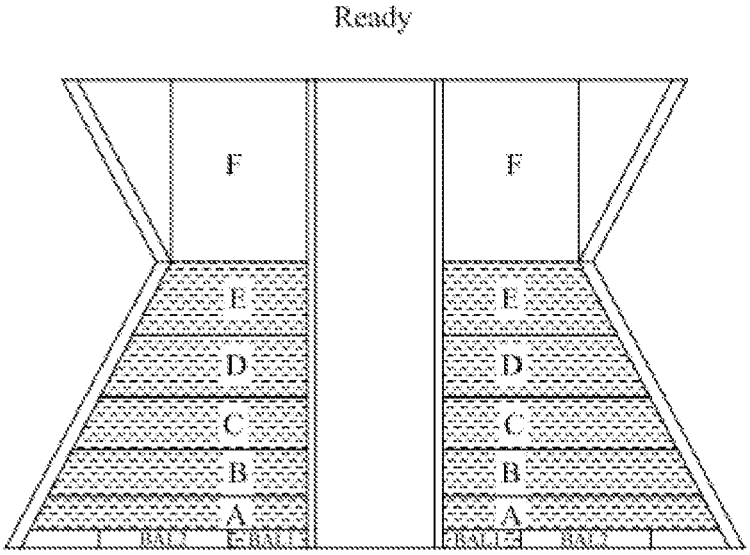
Figure 9:
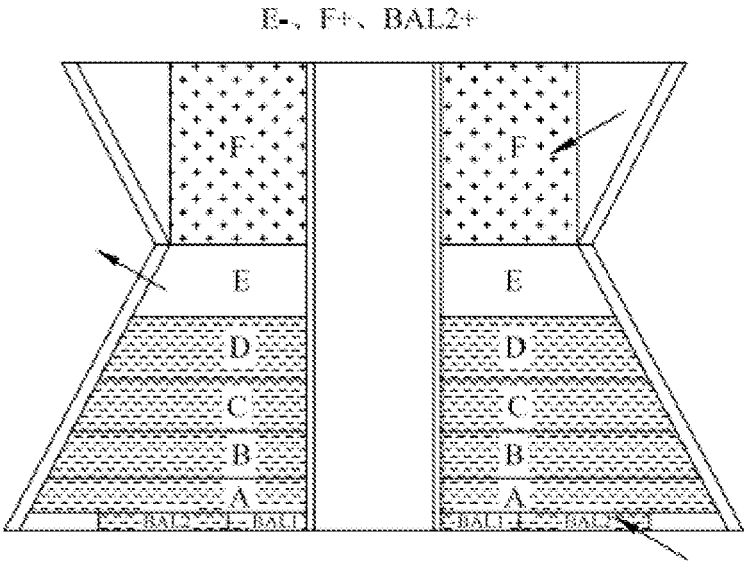
Figure 10:
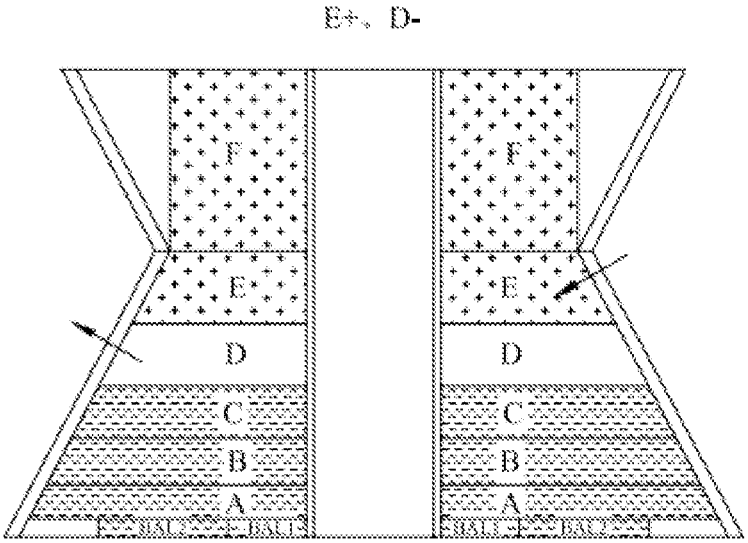
Figure 11:
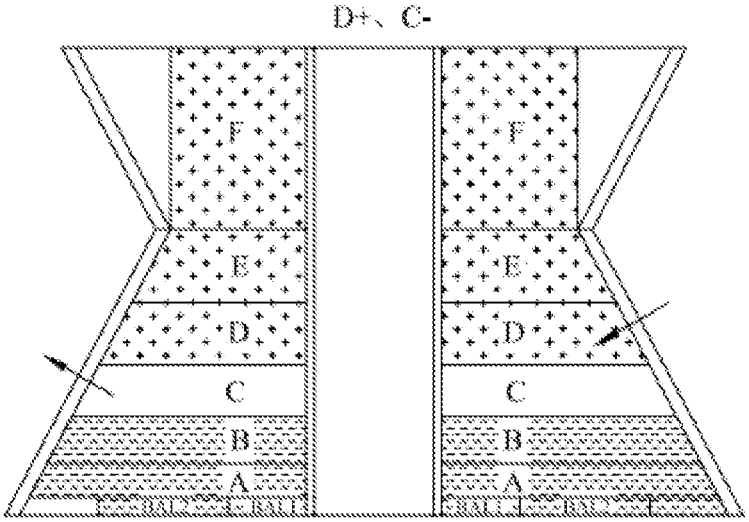
Figure 12:
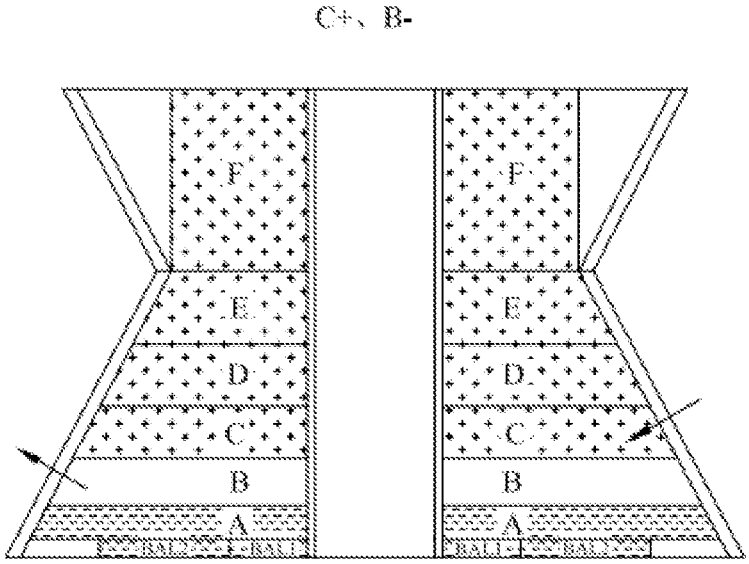
Figure 13:
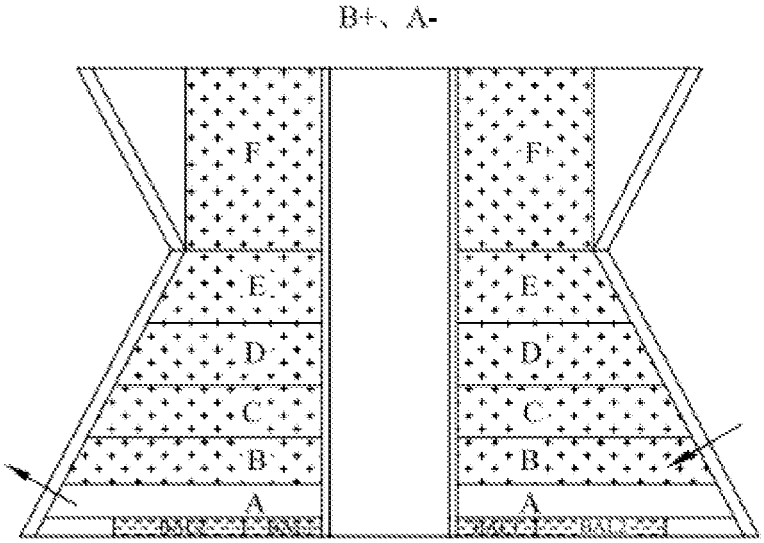
Figure 14:
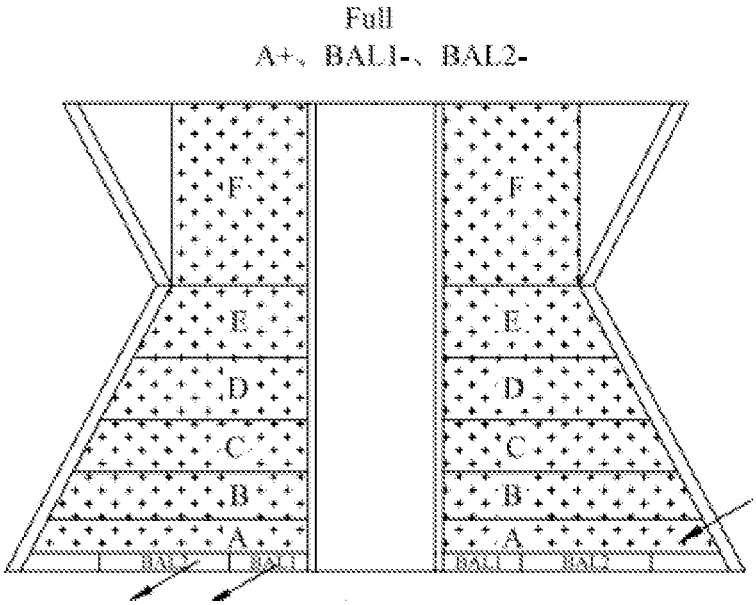

The technical solution in the embodiments of the present invention is described clearly and completely in conjunction with the accompanying drawings in the embodiments of the present invention in order to make the objective, the technical solution and the advantages of the present invention clearer:

As shown in FIG. 1, the floating platform comprises the double-layer hull and the double-layer bottom, and the section of the floating platform is shaped as a sand clock, wherein the waterplane stands for the narrowest part of the sand clock. Six annular compartments, namely the annular compartment IA, the compartment IIB, the compartment IIIC, the compartment IVD, the compartment VE and the compartment VIF are sequentially configured from bottom to top. The six compartments are of equal-ratio subdivision, namely $$\frac{V_B}{V_A} = \frac{V_C}{V_B} = \frac{V_D}{V_C} = \frac{V_E}{V_D} = \frac{V_F}{V_E} = \frac{\rho_{water}}{\rho_{oil}},$$

wherein, $V_A$, $V_B$, $V_C$, $V_D$, $V_E$ and $V_F$ are volumes of the annular compartment IA, the compartment IIB, the compartment IIIC, the compartment IVD, the compartment VE and the compartment VIF, respectively.

Embodiment I

Loading and Unloading Process

In order to ensure that the vertical position of the buoyant center and define the vertical change of the center of gravity to be always positioned in a safe and controllable range, the present invention formulates a set of novel loading and unloading process in combination with said subdivision design.

If the platform has a drilling function unit, two working conditions, namely a drilling working procedure and an oil production working procedure are generally mentioned. Under the drilling working procedure, the floating state is regulated by adopting ballast water as well to ensure that the waterplane of the platform is always kept at a full-load waterplane position. This process is clear and thus free of special illustration here. The loading and unloading process under the oil production working procedure will be illustrated in two stages to make it easy to understand:

at the first stage of the production working procedure: full-load of crude oil and start of raw oil output are as shown in FIGS. 1-7.

Under the full-load working processes, all oil storage compartments A, B, C, D, E and F are filled with oil and the load regulating compartments are in an unloaded state.

And the steps are performed as follows:

Step 1: evacuating all oil in the compartment A by pumping, wherein the two load regulating compartments BAL1 and BAL2 must be filled with water so as to ensure that the total mass of the platform is unchanged;

Step 2: evacuating all oil in the compartment B by pumping and fully filling the compartment A with water, wherein the volume of water in the load adjusting compartments is not changed since the mass of evacuated oil is equal to that of added water;

Step 3: adopting the same theory as Step 2, directly evacuating all oil in the compartment C by pumping and fully filling the compartment B with water;

Step 4: evacuating all oil in the compartment D by pumping and fully filling the compartment C with water;

Step 5: evacuating all oil in the compartment E by pumping and fully filling the compartment D with water; and Step 6: evacuating all oil in the compartment F by pumping and fully filling the compartment E with water, wherein all oil in BAL2 must be correspondingly evacuated since the volume of the compartment E is relatively larger than that of the compartment F and the mass of added water is larger than that of evacuated oil.

When oil in the compartment F is evacuated by pumping, the oil unloading process is ended, and the compartment F is not filled with water and is thus at an empty state for preparations of oil storage of next stage. As known from analysis on weight distribution change of the first stage, during which the whole center of gravity continuously descends, and the whole stability of the platform is continuously improved on the premise that the position of center of buoyance is unchanged.

At the second stage of the production working procedure: full-load of ballast water and start of crude oil input are as shown in FIGS. 8-14.

Under the full-load working conditions, all oil storage compartments A, B, C, D and E are filled with water, the compartment F is empty, the load regulating compartment BAL1 is filled with water and the load regulating compartment BAL2 is in an empty state.

And the following steps are performed as follows:

Step 1: fully filling the compartment F with oil, and simultaneously evacuating all water in the compartment E by pumping, wherein the compartment BAL2 must be fully filled with water to ensure that the floating state of the platform is maintained unchanged since the mass of water in the compartment E is larger than that of oil in the compartment F;

Step 2: fully filling the compartment E with oil and directly evacuating all water in the compartment D by pumping;

Step 3: fully filling the compartment D with oil and directly evacuating all water in the compartment C by pumping;

Step 4: fully filling the compartment C with oil and directly evacuating all water in the compartment B by pumping;

Step 5: fully filling the compartment B with oil and directly evacuating all water in the compartment A by pumping; and Step 6: fully filling the compartment A with oil and directly evacuating all water in the compartments BAL1 and BAL2 by pumping.

The platform is converted into a static balance state from a dynamic balance state for preparation of next round of work. As known from analysis on weight distribution change of the second stage, during which the position of whole center of gravity moves up continuously, and the whole stability of the platform is reduced continuously on the premise of unchanged position of center of buoyance, but always within a set variable range.

Figure 15:
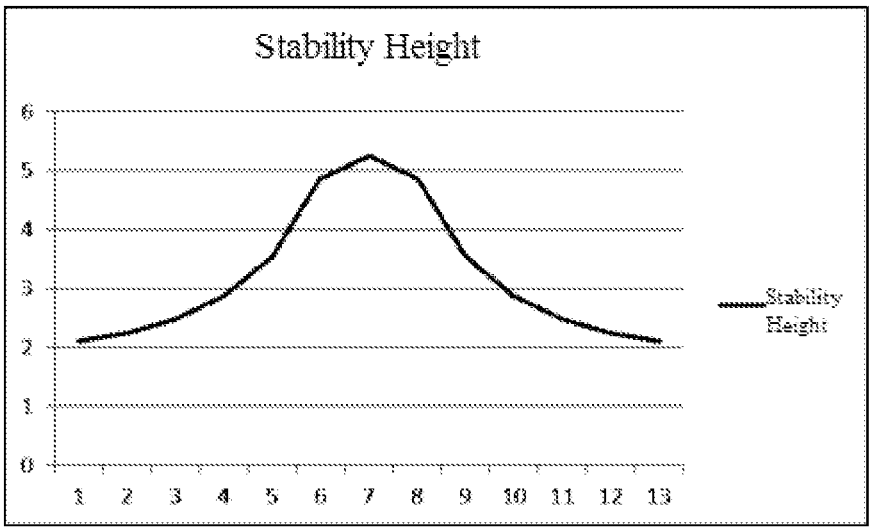
FIG. 15 is an effect schematic diagram of the embodiment of the present invention; and In drawings, A, B, C, D, E and F are compartments of the platform, which are distributed vertically and configured in six layers; '+' and '−' above each drawing represent loading and unloading for the compartment, respectively.

It is worthy of being illustrated that two treatment processes at the crude oil input stage and the crude oil output stage form a closed circulation, the position of the center of buoyance can be maintained unchanged in the input/output process no matterfrom which point the process is started, and the center of gravity fluctuates in a set range without affecting the whole stability and the hydrodynamic performance of the platform. The stability height change is as shown in FIG. 15.

As stated above, the preferable embodiments abovementioned of the present invention are described, however, the present invention is not limited to these embodiments specifically disclosed, equivalent replacement or change, made by any technical personnel skilled in the art disclosed in the present invention in accordance to the technical solution and inventive concept of the present invention, should fall into the protection scope of the present invention.

The invention claimed is:

1. A floating platform, comprising:

a first annular layer, a last annular layer, and one or more intermediary annular layers arranged in a vertical direction between the first annular layer and the last annular layer, each of the annular layers comprises a plurality of compartments, wherein a center of gravity of each of the annular layers and a center of gravity of the floating platform are located on a vertical line, wherein a volume ratio between two adjacent annular layers satisfies $$V_B/V_A=\rho_{water}/\rho_{oil},$$

wherein the two adjacent annular layers are any of two annular layers adjacent immediately to each other selected from the group consisting of the first annular layer, the last annular layer, and the one or more intermediary annular layers, and wherein $V_A$ is a total volume of a lower annular layer among the two adjacent annular layers, $V_B$ is a total volume of an upper annular layer among the two adjacent annular layers, $\rho_{water}$ is a density of seawater, and $\rho_{oil}$ is a density of a crude oil.

2. The floating platform according to claim 1, wherein the plurality of compartments in each of the annular layers are fluidly connected.

3. The floating platform according to claim 1, wherein each of the annular layers has a same inner diameter.

4. The floating platform according to claim 3, wherein each of the annular layers comprises a plurality of transverse bulkheads.

5. The floating platform according to claim 1, wherein the floating platform comprises a double-layer hull and a double-layer bottom, wherein the double-layer bottom comprises one or more annular load regulating compartments, and wherein the first annular layer is disposed immediately above the double-layer bottom.

6. The floating platform according to claim 5, wherein the double-layer bottom comprises an annular load regulating compartment I and an annular regulating compartment II, wherein a center of gravity of the annular load regulating compartment I and a center of gravity of the annular regulating compartment II coincide with each other, wherein a ratio of a sum of a volume of the annular load regulating compartment I and a volume of the annular load regulating compartment II and a total volume of the layer of compartments disposed above the double-layer bottom is equal to a ratio of a density of seawater and a density of crude oil.

7. A method of operating the floating platform of claim 5, comprising:

filling the one or more of the annular load regulating compartments with seawater;

emptying crude oil from the first annular layer;

filling the empty first annular layer with seawater;

emptying crude oil from and then filling seawater in each of the one or more intermediate annular layers; and emptying crude oil from the last annular layer so that the last annular layer is empty.

8. The method of claim 7, further comprising:

filling the empty last annular layer with crude oil;

emptying seawater from and then filling crude oil in each of the one or more intermediary annular layers;

emptying seawater from and then filling crude oil in the first annular layer; and emptying seawater from the one or more annular load regulating compartments.

9. The floating platform according to claim 5, wherein a ratio of a total volume of the one or more load regulating compartments to a total volume of the first annular layer is inversely proportional to a ratio of the density of seawater and the density of crude oil.

10. The method of claim 7, wherein each of the one or more intermediate layers in an upward direction are sequentially subject to the steps of emptying crude oil and filling seawater.

11. The floating platform according to claim 8, wherein each of the one or more intermediate layers in a downward direction are sequentially subject to the steps of emptying seawater and filling crude oil.

* * * * *